US005123392A

United States Patent [19]

Uchinami et al.

[11] Patent Number: 5,123,392

[45] Date of Patent: Jun. 23, 1992

[54] FUEL INJECTION APPARATUS FOR AN INTERNAL COMBUSTION ENGINE

[75] Inventors: Masanobu Uchinami; Kouichi Yamane; Koji Nishimoto, all of Himeji, Japan

[73] Assignee: Mitsubishi Denki Kabushiki Kaisha, Tokyo, Japan

[21] Appl. No.: 650,321

[22] Filed: Feb. 4, 1991

[30] Foreign Application Priority Data

Feb. 16, 1990 [JP] Japan ..... 2-36675

[51] Int. Cl.[5] ..... F02M 39/00

[52] U.S. Cl. ..... 123/492; 123/494

[58] Field of Search ..... 123/492, 493, 494

[56] References Cited

U.S. PATENT DOCUMENTS

| | | | |
|---|---|---|---|
| 4,457,283 | 7/1984 | Kobayashi | 123/492 |
| 4,534,331 | 8/1985 | van Belzen et al. . | |
| 4,607,603 | 8/1986 | Kobayashi | 123/492 |
| 4,729,362 | 3/1988 | Mori | 123/492 |
| 4,753,210 | 6/1988 | Fujimoto | 123/492 |
| 4,841,937 | 6/1989 | Nagaishi | 123/492 |
| 4,889,100 | 12/1989 | Nakaniwa | 123/492 |
| 4,911,132 | 3/1990 | Nakaniwa | 123/492 |
| 4,911,133 | 3/1990 | Sogawa | 123/494 |
| 4,984,552 | 1/1991 | Nishizawa | 123/492 |

*Primary Examiner*—Carl Stuart Miller

*Attorney, Agent, or Firm*—Sughrue, Mion, Zinn, Macpeak and Seas

[57] ABSTRACT

In one aspect of the present invention, fuel is injected through the injector into the internal combustion engine in non-synchronism with a predetermined crank angle or a predetermined ignition timing each time when the intake air pipe pressure traverses a predetermined set value from the smaller value side to the larger value side. In another aspect of the present invention, the fuel injection is effected in non-synchronism with the predetermined crank angle or the predetermined ignition timing when the intake air pipe pressure traverses a second predetermined value which is selected among a plurality of predetermined set values (the second predetermined value being larger in the absolute value than a first set value, and being close to the first set value) in a case that a time of traversing the first and second set values of the intake air pipe pressure is shorter than a predetermined time.

2 Claims, 6 Drawing Sheets

FUEL INJECTION APPARATUS FOR AN INTERNAL COMBUSTION ENGINE

BACKGROUND OF THE INVENTION

1. Field of the Invention

The present invention relates to a fuel injection apparatus without using a throttle opening sensor for an internal combustion engine to detect quickly an acceleration state of the engine and to effect fuel injection at the time of acceleration of the engine in non-synchronism with a crank angle or an ignition timing.

2. Discussion of Background

A conventional fuel injection apparatus for an internal combustion engine for an automobile is adapted to inject fuel in correspondence to an intake air quantity sucked into the combustion chamber of the engine. In the conventional fuel injection apparatus, there has been found a delay in fuel supply to the combustion chamber due to a delay of detecting the intake air quantity or a delay of transmitting the fuel in a time period from the injection into the intake air pipe to the suction into the combustion chamber in a transition state such as an acceleration of engine. Accordingly, it was difficult to maintain the optimum air-fuel ratio of the mixture.

In such state, it is necessary to increase an amount of fuel as soon as an acceleration state is detected. In the conventional fuel injection apparatus, a throttle opening sensor was used as an acceleration state detecting means in order to detect quickly a state of acceleration, and fuel was injected in non-synchronism with a crank angle or an ignition timing under the conditions that the accelerating state was detected and a change of the output of the throttle opening sensor exceeds a predetermined value, the detection being carried out at predetermined time intervals.

The conventional fuel injection apparatus had, however, such disadvantage that a throttle opening sensor was needed to detect the accelerating state and therefore, the manufacturing cost increased.

SUMMARY OF THE INVENTION

It is an object of the present invention to provide a fuel injection apparatus for an internal combustion engine excellent in cost performance and having a good response in a transition time.

In accordance with one embodiment of the present invention, there is provided a fuel injection apparatus for an internal combustion engine which comprises a detecting means to detect a pressure in the intake air pipe of an engine, an injector for injecting fuel into the engine, and a control means which calculates a fuel injection quantity to be injected through the injector on the basis of the output of the detecting means and actuates the injector in synchronism with a predetermined crank angle or a predetermined ignition timing, wherein the control means actuates the injector without synchronization with the predetermined crank angle or the predetermined timing when the output of the detecting means traverses a set value from the smaller value side of the set value to the larger value side.

In accordance with another embodiment of the present invention, there is provided a fuel injection apparatus for an internal combustion engine which comprises a detecting means to detect a pressure in the intake air pipe of an engine, an injector for injecting fuel into the engine, and a control means which calculates a fuel injection quantity to be injected through the injector on the basis of the output of the detecting means and actuates the injector in synchronism with a predetermined crank angle or a predetermined ignition timing, wherein the control means stores a first set value and a second set value which are close to each other among other set values stored regarding to the intake air pipe pressure, the second set value being larger in the absolute value than the first set value, and wherein when the output of the detecting means traverses the first and second set values from the first set value side, the control means actuates the injector without synchronization with the predetermined crank angle or the predetermined timing at the time when the output of the detecting means traverses the second set value in a case that a time of traversing the first and second set values of the output of the detecting means is shorter than a predetermined time.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
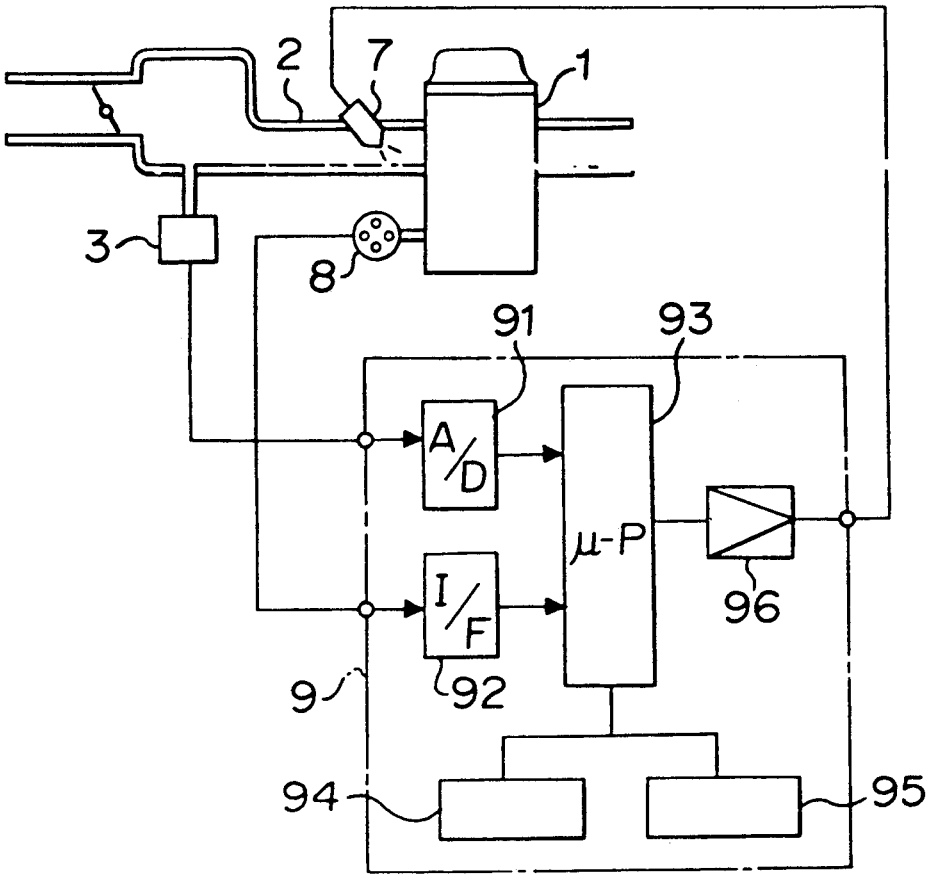
FIG. 1 is a block diagram showing an example of the fuel injection apparatus for an internal combustion engine according to the present invention.

Referring to the drawings wherein the same reference numerals designate the same or corresponding parts throughout several views and more particularly to FIG. 1, there is shown a block diagram of an embodiment of the present invention.

In FIG. 1, a reference numeral 1 designates an internal combustion engine for an automobile, and a numeral 2 designates an intake air pipe connected to the engine 1. A pressure sensor 3 as a detecting means detects a pressure in the intake air pipe 2. A detection signal, representing a pressure value in the intake air pipe 2, from the pressure sensor 3 is inputted into an analogue/-digital (A/D) converter 91 in a control unit 9 as a control means.

An injector 7 as a fuel injection means is disposed at the intake air pipe 2 at a position near the air intake port of each cylinder. Fuel is supplied to the injector 7 with a constant pressure.

A crank angle sensor 8 as a detecting means detects the revolution of the engine and produces a signal in a form of pulses. The output of the crank angle sensor 8 is inputted to an input circuit 92 in the control unit 9. The detecting means includes the pressure sensor 3 and the crank angle sensor 8.

The control unit 9 calculates a requisite fuel injection quantity on the basis of the outputs of the pressure sensor 3 and the crank angle sensor 8, and produces a pulse signal having a driving pulse width to the injector 7 on the basis of the calculation.

In the control unit 9, the A/D converter 91 receives an analogue signal from the pressure sensor 3, converts the analogue signal into a digital signal, and transmits it to a microprocessor 93.

The input circuit 92 receives the pulse signal of the crank angle sensor 8 and performs the level change of the pulse signal. The level-changed pulse signal is transmitted from the input circuit 92 to the microprocessor 93.

The microprocessor 93 calculates a fuel quantity to be supplied to the engine 1 on the basis of the digital signal and the pulse signal obtained from the A/D converter 91 and the input circuit 92, respectively, and supplies a driving pulse signal having a pulse width according to a result of the calculation to the injector 7 through an output circuit 96, whereby the injector 7 is actuated. A numeral 94 designates a read only memory (ROM) which stores operating programs for operating the microprocessor 93 and data. A numeral 95 designates a random access memory (RAM) which temporarily stores data in a course of the calculation of the microprocessor 93.

Explanation will be made as to the operation of a whole cylinder simultaneous injection system in a 4-cycle-4-cylinder engine.

Figure 2:
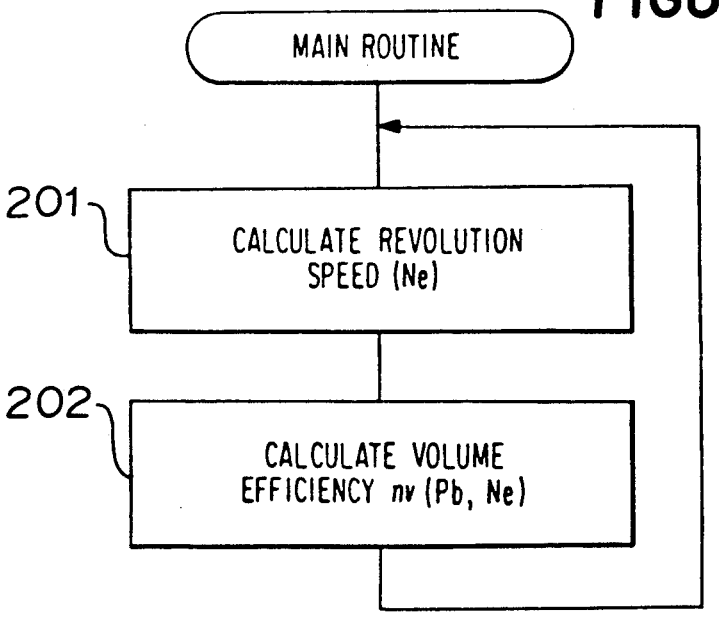
FIG. 2 is a flow chart showing an example of the main operational routine of the embodiment shown in FIG. 1.

FIG. 2 is a flow chart showing the main calculation processing routine according to an embodiment of the present invention.

Figure 4:
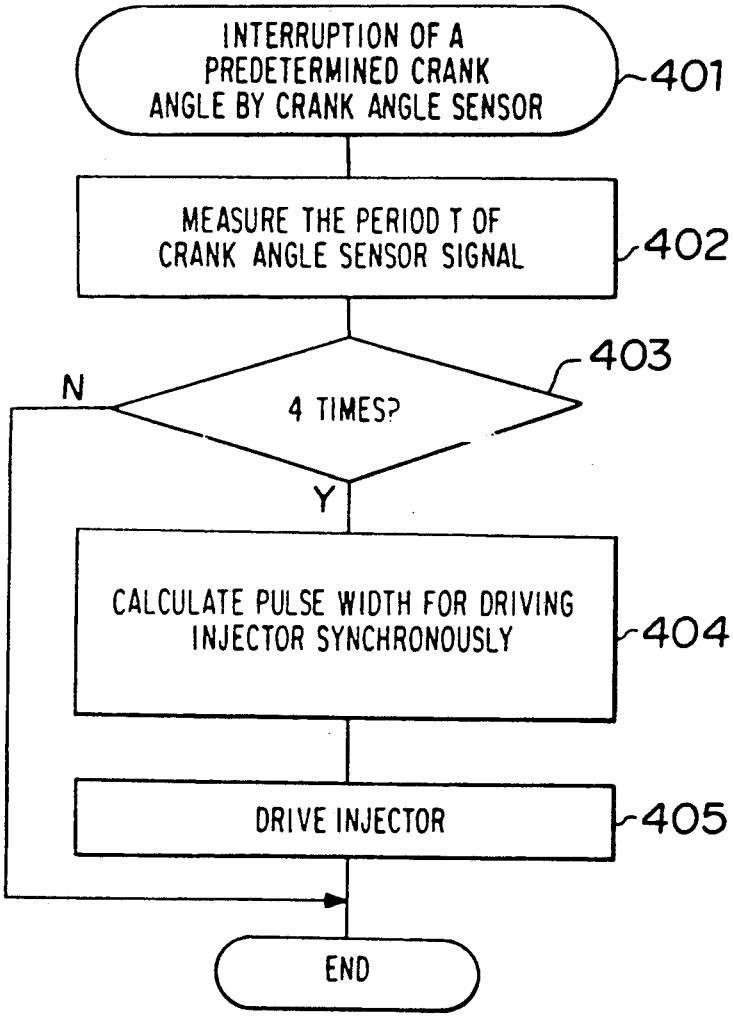
FIG. 4 is a flow chart showing interruption routine which is effected by a crank angle sensor at every crank angle in the above-mentioned embodiment.
Figure 5:
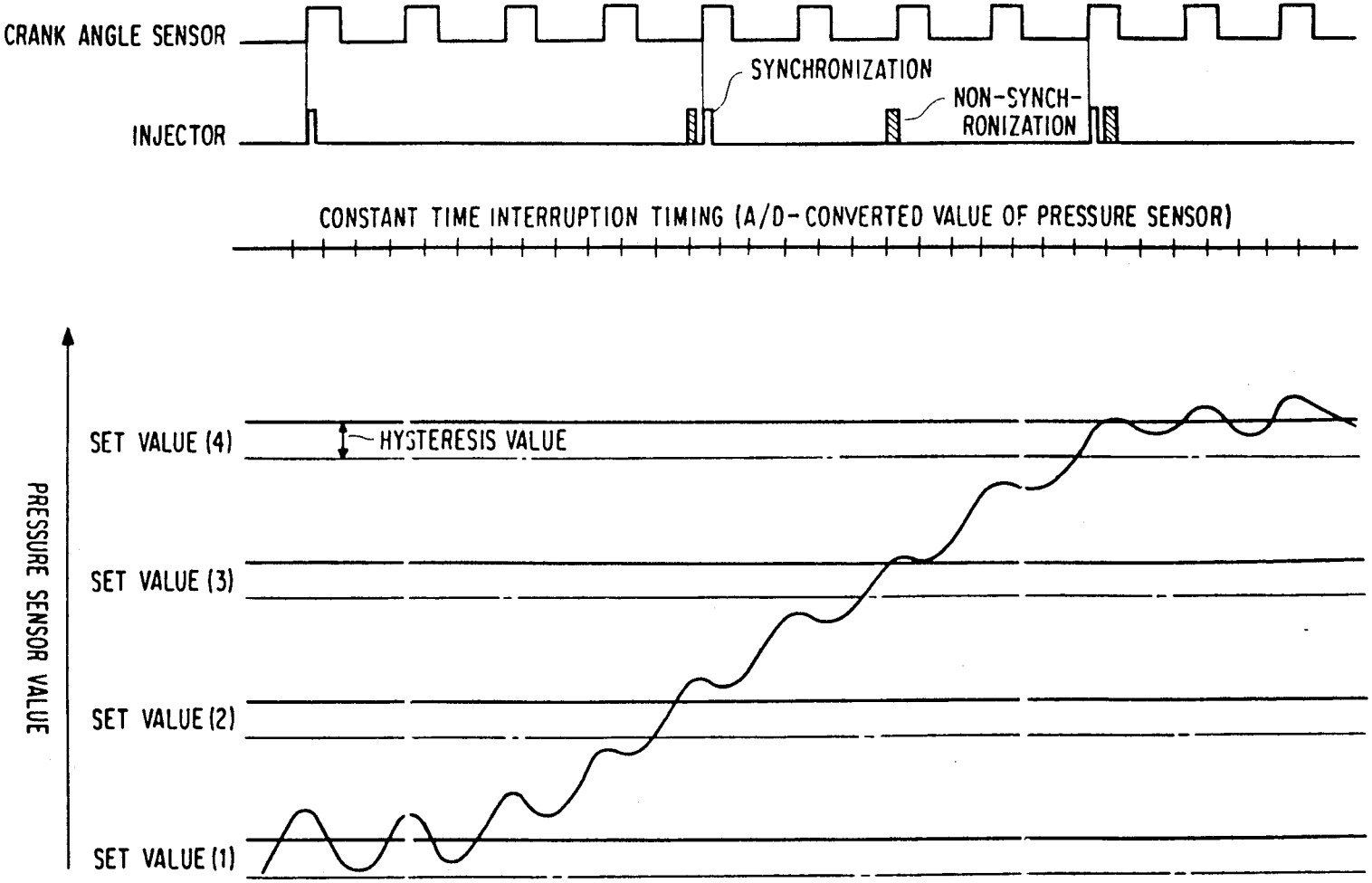
FIG. 5 is a time chart for the explanation of the operation of the embodiment as shown in FIG. 1.

At Step 201, the revolution speed Ne of the engine 1 is calculated on the basis of the period T of the crank angle sensor signal, which is measured at Step 402 (FIG. 4), from the crank angle sensor 8. The main routine is interrupted at every predetermined crank angle as shown in FIG. 5.

Figure 3:
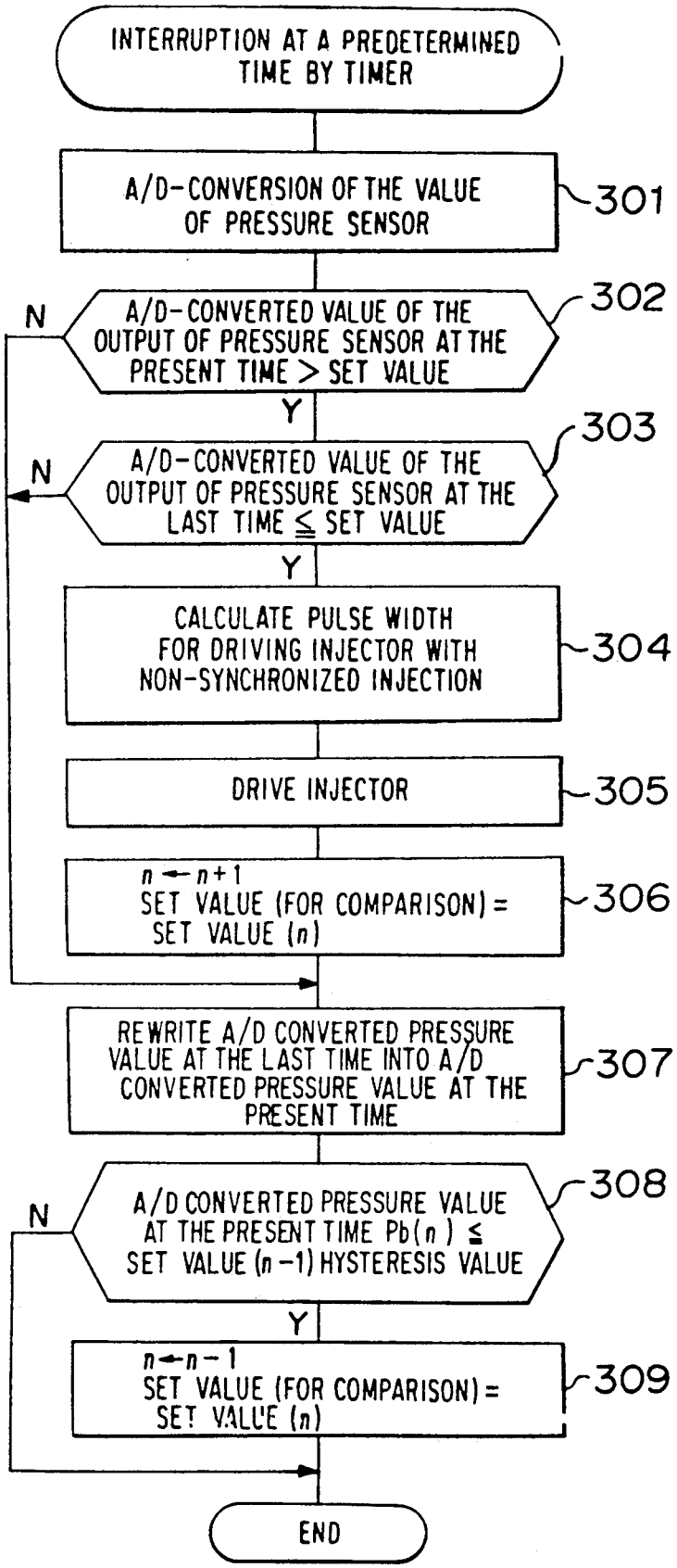
FIG. 3 is a flow chart showing an example of interruption routine effected by a timer in the embodiment as shown in FIG. 1.

At Step 202, the microprocessor 93 calculates by complementary operation a value of volume efficiency $\eta v(Pb,Ne)$ which is previously stored in the ROM 95 on the basis of the engine revolution speed Ne obtained at Step 201 and an intake air pipe pressure Pb which is an A/D converted value of the output of the pressure sensor 3 (the A/D converted value being obtained at Step 301 in the interruption routine as shown in FIG. 3, (which is effected by the actuation of the timer). Then, the processing routine as in FIG. 4 is conducted.

At Step 403, determination is made as to whether or not 4 times of turn of crank angle are counted by the crank angle sensor 8. When the crank angle sensor 8 counts 4 times of turn of the crank angle, then, the microprocessor 93 calculates a pulse width for driving the injector 7 so as to be able to effect the synchronizing fuel injection at Step 404. At Step 405, the injector 7 is driven for fuel injection with a signal having the driving pulse width which is calculated by the microprocessor 93.

On the other hand, when the crank angle sensor 8 does not count 4 times of turn of the crank angle at Step 403, the calculating operations as described above is finished.

The processing routine as in FIG. 3 will be described. In the embodiment as described above, fuel is injected to the engine in non-synchronism with a predetermined crank angle or a predetermined ignition timing at each time the intake air pipe pressure detected by the detecting means traverses a set value from the smaller value side of the set value to the larger value side.

The processing routine as shown in FIG. 3 is executed at every predetermined time interval (for instance, 3 msec).

At Step 301, the output value of the pressure sensor 3 is subjected to A/D conversion at the A/D converter 91, and the A/D converted digital value is read by the microprocessor 93.

At Step 302, determination is made as to whether or not the A/D-converted digital value which is detected by the pressure sensor 3 at the present time is larger than a set value (a reference value) n. When the A/D-converted value is larger than the set value n, the sequential step is moved to Step 303. Otherwise, the sequential step is moved to Step 307.

At Step 303, determination is made as to whether or not the A/D converted digital value of the pressure sensor 3 detected at the last time is equal to or smaller than the set value (reference value) n. When it is found that the A/D-converted digital value of the pressure sensor 3 at the last time is larger than the set value n, the sequential step is moved to Step 307. Otherwise, the sequential step is moved to Step 304. Thus, the fact that the A/D-converted value of the output of the pressure sensor 3 traverses the set value n from the smaller value side to the larger value side is checked at Steps 302 and 303. The set value is so determined as to be a larger value than the currently detected value of the intake air pipe pressure and to be the nearest value to the currently detected value in view of Step 306 and 309.

As described above, when the A/D-converted value of the pressure sensor 3 detected at the last time is smaller than the set value n, namely, when the intake air pipe pressure traverses the set value, the processing routine of Step 304 and the following Steps are taken. Otherwise, the processing step is moved to Step 307.

At Step 304, the driving pulse width is calculated in consideration of a signal value from a water temperature sensor and so on (not shown in FIG. 1) so as to effect non-synchronizing injection. Then, the injector 7 is actuated by an instruction signal with the driving pulse width from the microprocessor 93 through the output circuit 96 at Step 305.

In the Steps described before, the intake air pipe pressure value detected by the pressure sensor 3, namely, the A/D-converted value of the output of the pressure sensor 3 traverses the set value n from the smaller value side to the larger value side. At Step 306, a value which is larger than the present pressure value is determined as the next set value (n+1), which is used as a reference value in the next time, in the RAM 95 by the function of the microprocessor 93.

At Step 307, the A/D-converted value of the output at the present time of the pressure sensor 3 is memorized as the A/D-converted value at the last time in the RAM 95.

At Step 308, checking is made as to whether or not the intake air pipe pressure value traverses the set value from the larger value side to the smaller value side. When it is found that the pressure value traverses the set value from the larger value side to the smaller value side, the sequential step is moved to Step 309. On the other hand, when negative, the sequential step is terminated. In this case, there may be a hunting phenomenon due to a ripple in the output signal of the pressure sensor 3 as shown in FIG. 5. In order to prevent the hunting phenomenon of the output signal from occurring, a hysteresis value which should be larger than a possible ripple is added to each of the set values (1) through (4) for the output of the pressure sensor 3 (FIG. 5). When the intake air pipe pressure value traverses any of the set values from the larger value side to the smaller value side, the set value is rewritten to be the next smaller set value (n−1) at Step 309.

FIG. 5 is a time chart for explaining the first embodiment of the fuel injection apparatus of the present invention. As seen from FIG. 5, while fuel is injected in synchronism with the time when the crank angle sensor 8 detects each 4th revolution of the crank shaft, non-synchronizing fuel injection is effected at each timing of interruption routine (which is conducted at predetermined time intervals in a case that the intake air pipe pressure value traverses any of the set values (2)-(4) from the smaller value side to the larger value side.

Figure 6:
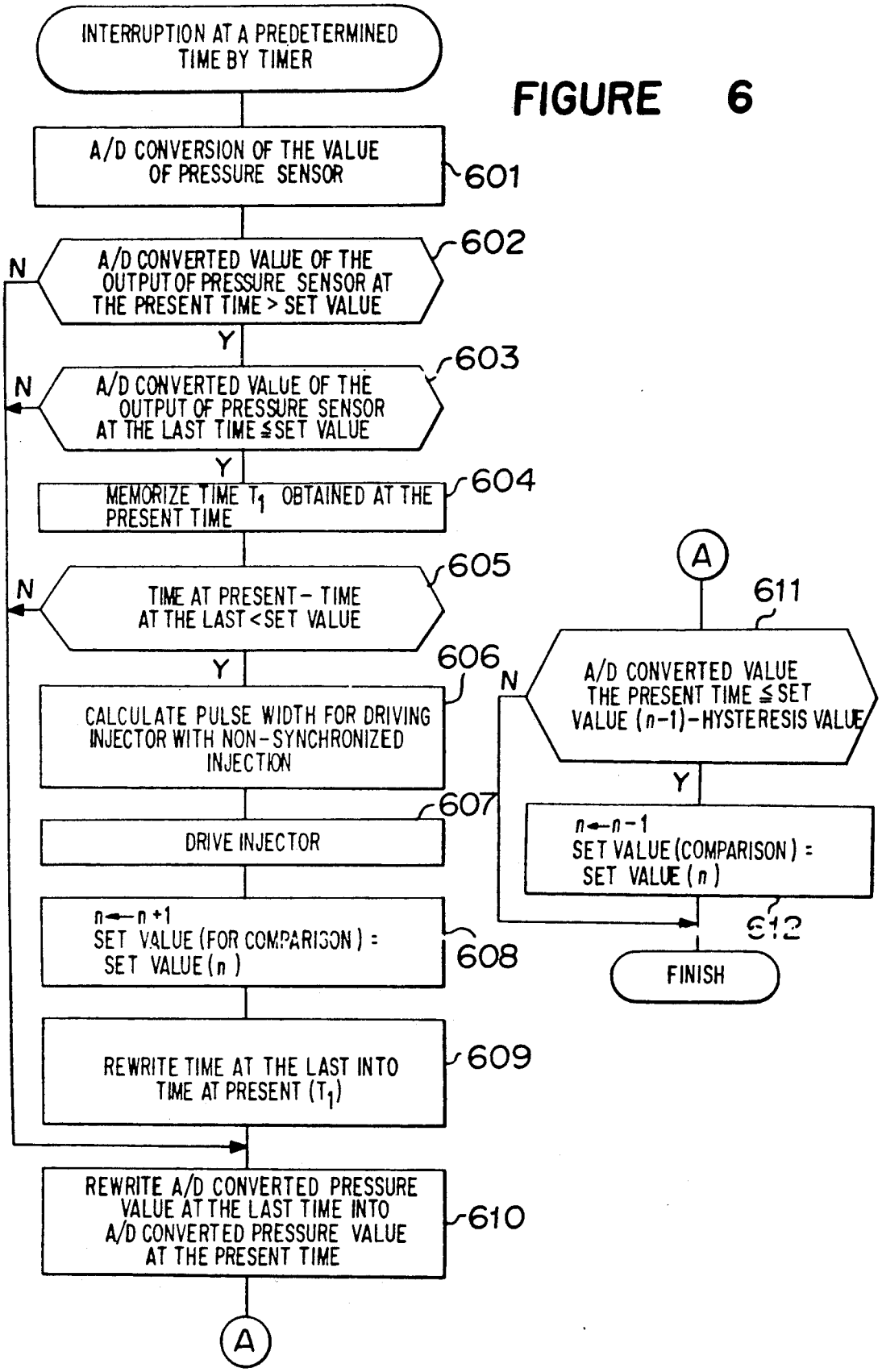
FIG. 6 is a time chart showing interruption routine by a timer in another embodiment of the fuel injection apparatus for an internal combustion engine according to the present invention.

The operation of a second embodiment of the fuel injection apparatus of the present invention will be described with reference to a flow chart as shown in FIG. 6.

In the second embodiment, fuel is injected in non-synchronism with at each predetermined crank angle or each predetermined ignition timing when the intake air pipe pressure or the Q/N traverses a second set value which is determined among a plurality of predetermined set values (the second set value is close to a first set value and is, in the absolute value, larger than the first set value) in a case that a time required for the intake air pipe pressure to traverse the first and second set values is shorter than a predetermined time.

In FIG. 6, the processing routine is executed for every predetermined time in the same manner as that in FIG. 3.

At Step 601, the output value of the pressure sensor 3 is A/D-converted at the A/D converter 91 and is read in the microprocessor 93.

At Step 602, determination is made as to whether or not the A/D-converted value of the output of the pressure sensor 3 detected at the present time is larger than a set value n. When the determination is negative, the sequential step is moved to Step 610. On the other hand, when the determination is affirmative, the proceeding at Step 603 is taken. At Step 603, determination is made as to whether or not the A/D-converted value of the output of the pressure sensor 3 detected at the last time is equal to or smaller than the set value n. When the determination is affirmative, the sequential step is moved to Step 604. On the other hand, the determination is negative, the sequential step is moved to Step 610. Thus, the determination as to whether or not the A/D-converted value of the output of the pressure sensor 3 has traversed the set value n from the smaller value side to the larger value side is conducted during Steps 602 and 603.

The set value is always selected to be the one n at Steps 608 and 612 in the same manner as in FIG. 3 that the set value should be larger than the currently detected value of intake air pipe pressure and the nearest to the currently detected value.

When it is found that the intake air pipe pressure has traversed the set value (reference value), the time of traversing the set value at this moment is stored at Step 604. At Step 605, determination is made as to whether or not the difference between the memorized value of time measured at the last time and the value of time measured at the present time is shorter than a predetermined time value. Namely, a time requiring the traversing between the set value n and the set value (n+1) is measured. When it is found that the measured time is relatively short (for instance, within 30 msec), it means that a rapid acceleration is given to the engine. In this case, a non-synchronizing injection of fuel is required, and the sequential step is moved to Step 606.

On the other hand, when it is found at Step 605 that the time required to traverse the set value n and the set value (n+1) is relatively long, it means that a slow acceleration is given to the engine. Then, the sequential step is moved from Step 605 to Step 610.

At Step 606, a pulse width for actuating the injector 7 in a non-synchronizing manner with respect to a predetermined crank angle or a predetermined ignition timing, is calculated on the basis of a signal from a water temperature sensor (not shown in FIG. 1) and other signals. At Step 607, the injector is driven to inject fuel in non-synchronization with the predetermined crank angle or the ignition timing by providing a driving pulse signal having the pulse width calculated at Step 606.

At Step 608, the set value (n+1), which is larger than the pressure value detected at the present time and is used for comparison at the next occasion is stored in the RAM 95. It is because the pressure value of the intake air pipe traverses the set value n from the smaller value side to the larger value side.

At Step 609, the time of the traversing of the set value at the last time is replaced by the time of the traversing of the set value at the present time. Then, the sequential step is moved to Step 610 where the A/D-converted value of the pressure sensor 3 detected at the last time is rewritten into the A/D converted value of the pressure sensor 3 at the present time. Then, Step 611 is taken.

At Step 611, determination is made as to whether or not the pressure value of the intake air pipe traverses the set value from the larger value side to the smaller value side. In this case, a hystericis value which is larger in level than a ripple is added in the determination in order to prevent a hunting phenomenon caused by a ripple in the output signal of the pressure sensor 3.

At Step 612, the set value is rewritten into a smaller set value (n−1) in a case that the pressure value traverses the set value from the larger value side to the smaller value side.

Figure 7:
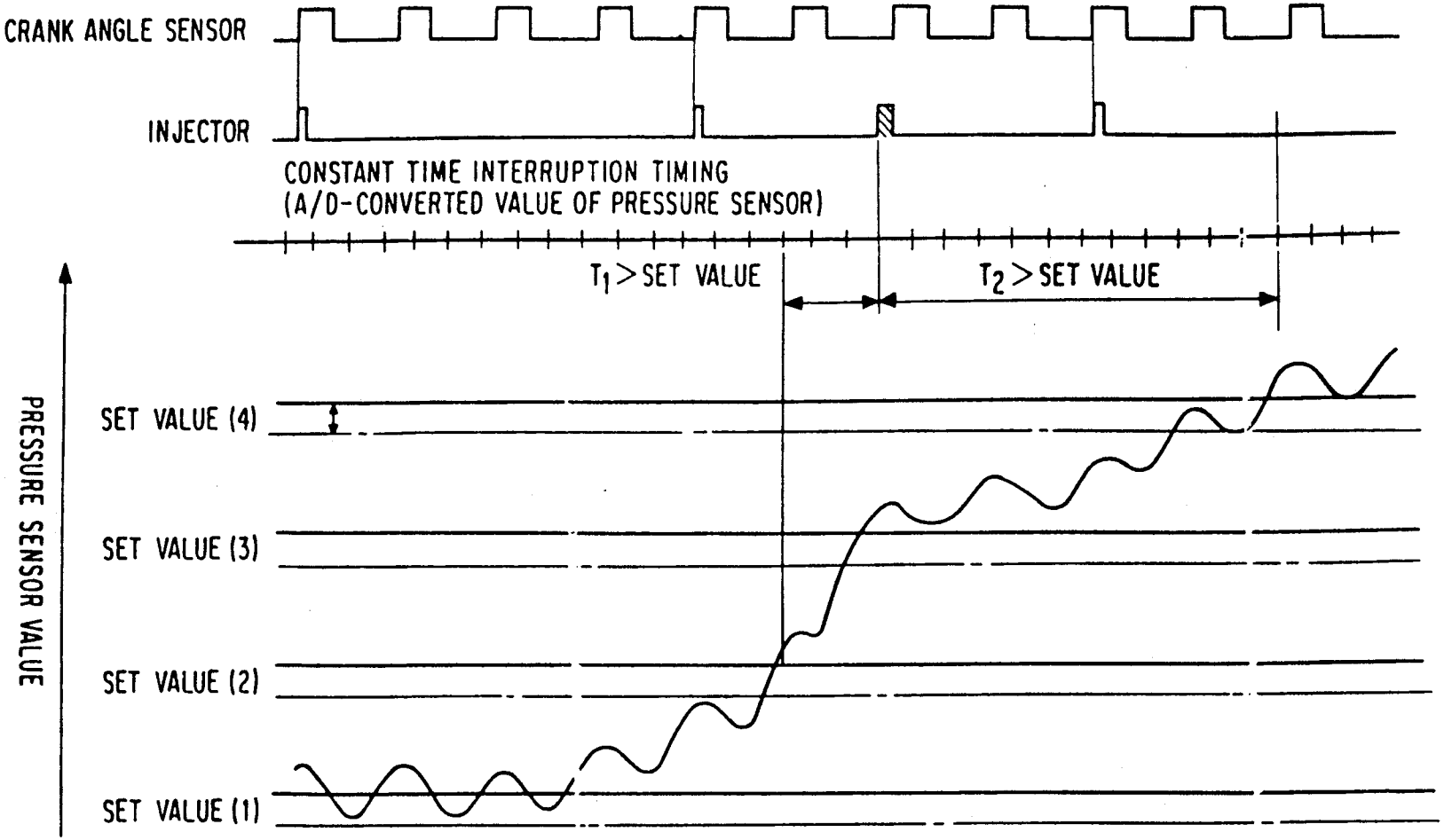
FIG. 7 is a time chart for the explanation of the operation of the second embodiment of the present invention.

FIG. 7 is a time chart for explaining the operation of the second embodiment of the fuel injection apparatus according to the present invention. In the second embodiment, the crank angle sensor 8 detects every fourth revolution of the crank shaft and the injector 7 is actuated to inject fuel in synchronism with the detection by the crank angle sensor 8. In addition of this, the microprocessor 93 actuates the injector to inject fuel in non-synchronism with the detection by the crank angle sensor 8 under the judgment that a rapid acceleration has been given to the engine in a case that the intake air pipe pressure traverses the set value (3), and a time period $T_1$, which is from the time at which the intake air pipe pressure traverses the set value (2) to the time at which the intake air pipe pressure traverses the set value (3), is smaller than a previously set time period. Let's assume that the intake air pipe pressure value traverses the set value (4). In this case, since a time period $T_2$, which is from the time at which the pressure value traverses the set value (3) to the time at which the pressure value traverses the set value (4), is longer than the previously set time period. Accordingly, it is judged that a slow acceleration has been given to the engine. Accordingly, the non-synchronization fuel injection is regarded as being unnecessary and the instruction of non-synchronization fuel injection is not supplied to the injector 7.

Thus, in the first embodiment of the present invention, fuel is injected through the injector into the internal combustion engine in non-synchronism with a predetermined crank angle or a predetermined ignition timing each time when the intake air pipe pressure traverses a predetermined set value from the smaller value side to the larger value side. In the second embodiment of the present invention, the fuel injection is effected in non-synchronism with the predetermined crank angle or the predetermined ignition timing when the intake air pipe pressure traverses a second predetermined value which is selected among a plurality of predetermined set values (the second predetermined value being larger in the absolute value than a first set value, and being close to the first set value) in a case that a time of traversing the first and second set values of the intake air pipe pressure is shorter than a predetermined time. Thus, a fuel injection apparatus for an internal combustion engine having excellent cost performance and a good transition response can be provided.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel injection apparatus for an internal combustion engine, comprising:

detecting means for detecting a pressure in an intake air pipe of an engine, an injector for injecting fuel into the engine, and control means for:

a) calculating a fuel injection quantity to be injected through the injector on the basis of the output of the detecting means and actuating the injector in synchronism with a predetermined crank angle or a predetermined ignition timing, b) actuating the injector asynchronously when the output of the detecting means traverses a set value range from a smaller value side thereof to a larger value side, c) incrementing the set value range to a higher level after said traversal, and d) decrementing the set value range to a lower level after a traversal from a larger value side thereof to a smaller value side.

2. A fuel injection apparatus for an internal combustion engine which comprises:

a detecting means to detect a pressure in the intake air pipe of an engine, an injector for injecting fuel into the engine, and a control means which calculates a fuel injection quantity to be injected through the injector on the basis of the output of the detecting means and actuates the injector in synchronism with a predetermined crank angle or a predetermined ignition timing, wherein the control means stores a first set value and a second set value which are close to each other among other set values stored regarding to the intake air pipe pressure, the second set value being larger in the absolute pressure value than the first set value, and wherein when the output of the detecting means traverses the first and second set values from the first set value side, the control means actuates the injector without synchronization with the predetermined crank angle or the predetermined timing at the time when the output of the detecting means traverses the second set value in a case that a time of traversing the first and second set values of the output of the detecting means is shorter than a predetermined time.

* * * * *